US008433218B2

(12) United States Patent
Suzuki

(10) Patent No.: US 8,433,218 B2
(45) Date of Patent: Apr. 30, 2013

(54) IMAGE FORMING DEVICE

(75) Inventor: Masayuki Suzuki, Tokyo (JP)

(73) Assignee: Oki Data Corporation, Tokyo (JP)

( * ) Notice: Subject to any disclaimer, the term of this patent is extended or adjusted under 35 U.S.C. 154(b) by 414 days.

(21) Appl. No.: 12/759,397

(22) Filed: Apr. 13, 2010

(65) Prior Publication Data

US 2010/0260514 A1 Oct. 14, 2010

(30) Foreign Application Priority Data

Apr. 14, 2009 (JP) ..... 2009-097698

(51) Int. Cl.
*G03G 21/16* (2006.01)
*G03G 15/08* (2006.01)

(52) U.S. Cl.
USPC ..... 399/111; 399/121

(58) Field of Classification Search ..... 399/111, 399/116, 124, 125, 121
See application file for complete search history.

(56) References Cited

U.S. PATENT DOCUMENTS 7,656,421 B2 * 2/2010 Itabashi ..... 347/138

FOREIGN PATENT DOCUMENTS

| | | |
|---|---|---|
| JP | A-2002-062743 | 2/2002 |
| JP | A-2003-215880 | 7/2003 |
| JP | A-2006-235528 | 9/2006 |

* cited by examiner

*Primary Examiner* — David Gray
*Assistant Examiner* — Gregory H Curran
(74) *Attorney, Agent, or Firm* — Posz Law Group, PLC

(57) ABSTRACT

An image forming device includes a carrying device configured to carry a recording sheet in a predetermined carrying direction, and a plurality of image forming units that are arranged along the carrying direction and that are in contact with the carrying device. All of the image forming units are configured to be separable from the carrying device when one of the image forming units is detached from the carrying device.

17 Claims, 8 Drawing Sheets

IMAGE FORMING DEVICE

CROSS REFERENCE TO RELATED APPLICATION

The present application is related to, claims priority from and incorporates by reference Japanese patent application number 2009-097698, filed on Apr. 14, 2009.

TECHNICAL FIELD

The present application relates to an image forming device such as a color electrophotographic printer and a corresponding electrophotographic method.

BACKGROUND

Conventionally, an image forming device using electrophotographic recording to form an image by transferring a toner image to a recording sheet from a photosensitive drum that is an image carrier is widely known. In this kind of image forming device, consumable parts such as a photosensitive drum, a charging device, a cleaning device and a developing device are configured as one unit as an image forming unit (or process cartridge), and are detachably mounted on the image forming device to enable the consumable parts to be easily changed.

In recent years, for example, as described in Japanese laid open patent publication number 2006-235528, a tandem type color image forming device has been developed in which toner images of different colors are formed on a plurality of photosensitive drums, and toner images are overlayed on a rerecording sheet carried by the sheet carrying device having a transfer belt or the like.

The color image forming device is formed from a frame that surrounds all of the image forming units and a linkage mechanism that connects the frame and the color image forming device. The frame can be lifted to create a large space between the image forming unit and the sheet carrying device when jamming (sheet jamming) occurs to enable a jammed recording sheet that remains on the sheet carrying; device to be removed.

However, there has always been a problem in that the work required to remove the recording sheet in the conventional image forming device is a large scale job, as the structure of the device is complicated.

Therefore, in view of the above, the present application describes an image forming device having a simple configuration that enables a recording sheet to be easily removed when jamming or the like occurs.

SUMMARY

An image forming device of the present application includes a carrying device configured to carry a recording sheet in a predetermined carrying direction, and a plurality of image forming units that are arranged along the carrying direction and that are in contact with the carrying device, wherein all of the image forming units are configured to be separable from the carrying device when one of the image forming units is detached from the carrying device.

In another aspect of the present application, an image forming device includes a carrying device configured to carry a recording sheet in a predetermined carrying direction, and a plurality of image forming units that are arranged along the carrying direction and that are in contact with the carrying device, wherein the image forming units and the carrying device are configured to be separable from one another when one of the image forming units is detached from the carrying device.

In another aspect of the present application, an image forming device includes a main body that is a frame of the image forming device and that includes a carrying device configured to carry a recording sheet in a predetermined carrying direction and image forming units arranged along the carrying direction and in contact with the carrying device, guides disposed on inner sides of the main body corresponding to each of the image forming units, shafts that are parts of the image forming units and that configured to fit in the guides so that the shafts are movable in the guides according to detaching and mounting operations of the image forming units, levers that are respectively positioned in the vicinity of the guides, that have a first arm part and a second arm part, and that are respectively fixed to the main body at lever supporting points such that the levers are rotatable around lever supporting points, lock members that are respectively positioned at sides opposite to the levers with respect to the guides, and that are respectively configured to engage with the second arm parts of the levers, and be biased toward the levers, and a first linkage that connects the levers so that the levers rotate in a synchronous manner. When the image forming units are mounted, the shafts push back the lock members so that the second arm parts do not engage with the lock members, when one of the image forming units is detached, the shaft of the detached image forming unit pushes back the first arm part of the lever for the detached image forming unit so that the lever rotates around the lever supporting point in a detach direction, thereby causing the second arm part of the lever for the detached image forming unit to engage with the lock member of the detached image forming unit, and the first linkage moves so that levers for the remaining image forming units rotate in the detach direction, the second arm parts for the remaining image forming units push the shafts of the remaining image forming units upwardly so that all of the image forming units are separated from the carrying device, and when the image forming unit is removed, the lock member of the detached image forming unit still engages with the second arm part because of the biasing force so that the first linkage maintains all of the image forming units separated from the carrying device.

According to a first embodiment of the image forming device, one of the image forming units can be easily and simply separated from a carrying device by detaching the image forming unit from the carrying device through a simple detaching operation. Detaching the image forming unit also causes the other image forming units to be lifted and separated from the carrying device. According to an image forming device of a second embodiment, all of the image forming units can be easily and simply separated from the carrying device as the one image forming unit is separated from the carrying device by the detaching operation of the one image forming unit. In addition, according to the second embodiment of the image forming device, the detaching operation also causes the carrying device to be lowered, thereby increasing the distance between the carrying device and the image forming units. Subsequently, the recording sheet on the carrying device can be more easily removed.

Figure 7:
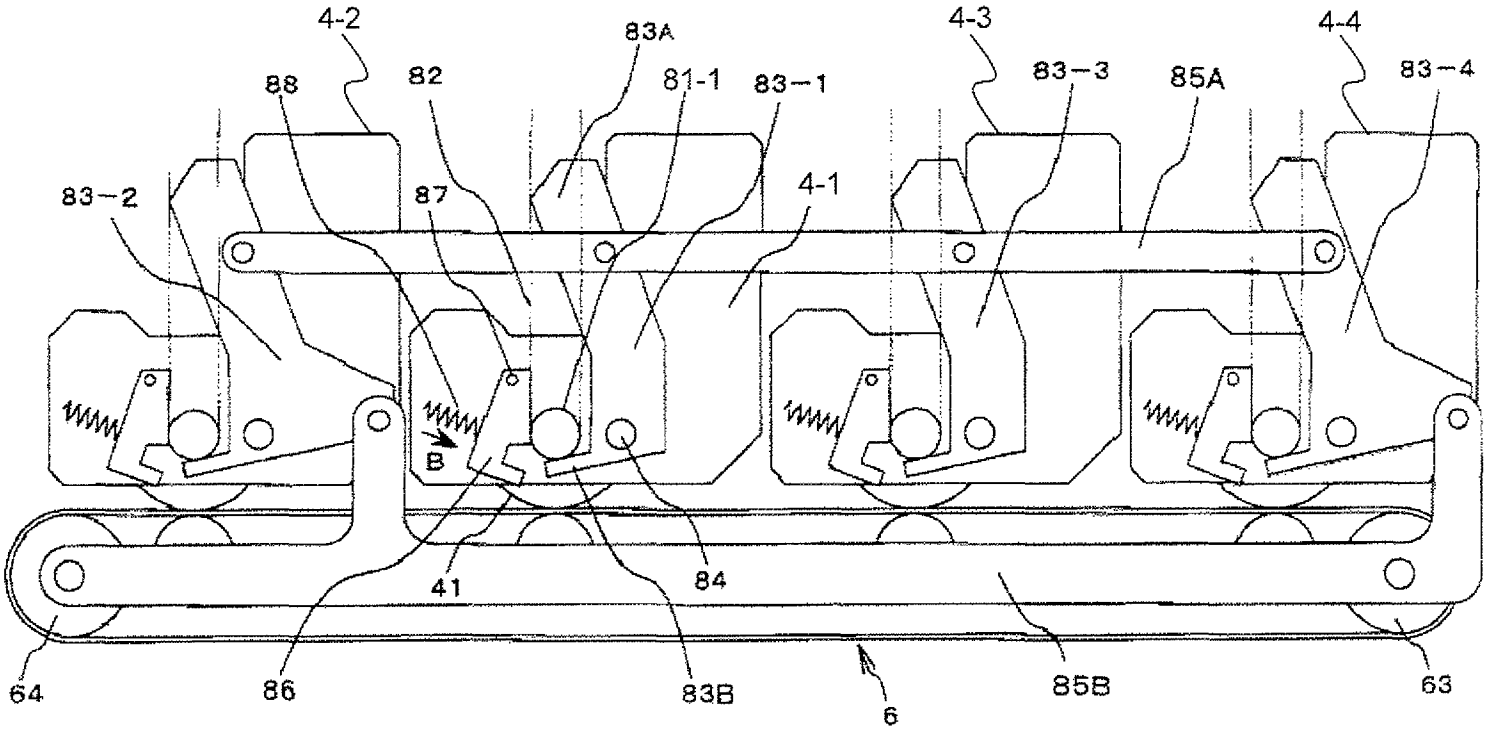
FIG. 7 illustrates a diagram showing a release mechanism of a process cartridge of an image forming device of a second embodiment.

FIG., 8 illustrates a diagram showing an operation condition of the release mechanism of FIG. 7.

DETAILED DESCRIPTION

The embodiments of the present invention become clear when the embodiments are explained with reference to the attached drawings. However, the drawings are to explain the present invention, and should not limit the scope of the present invention.

Figure 1:
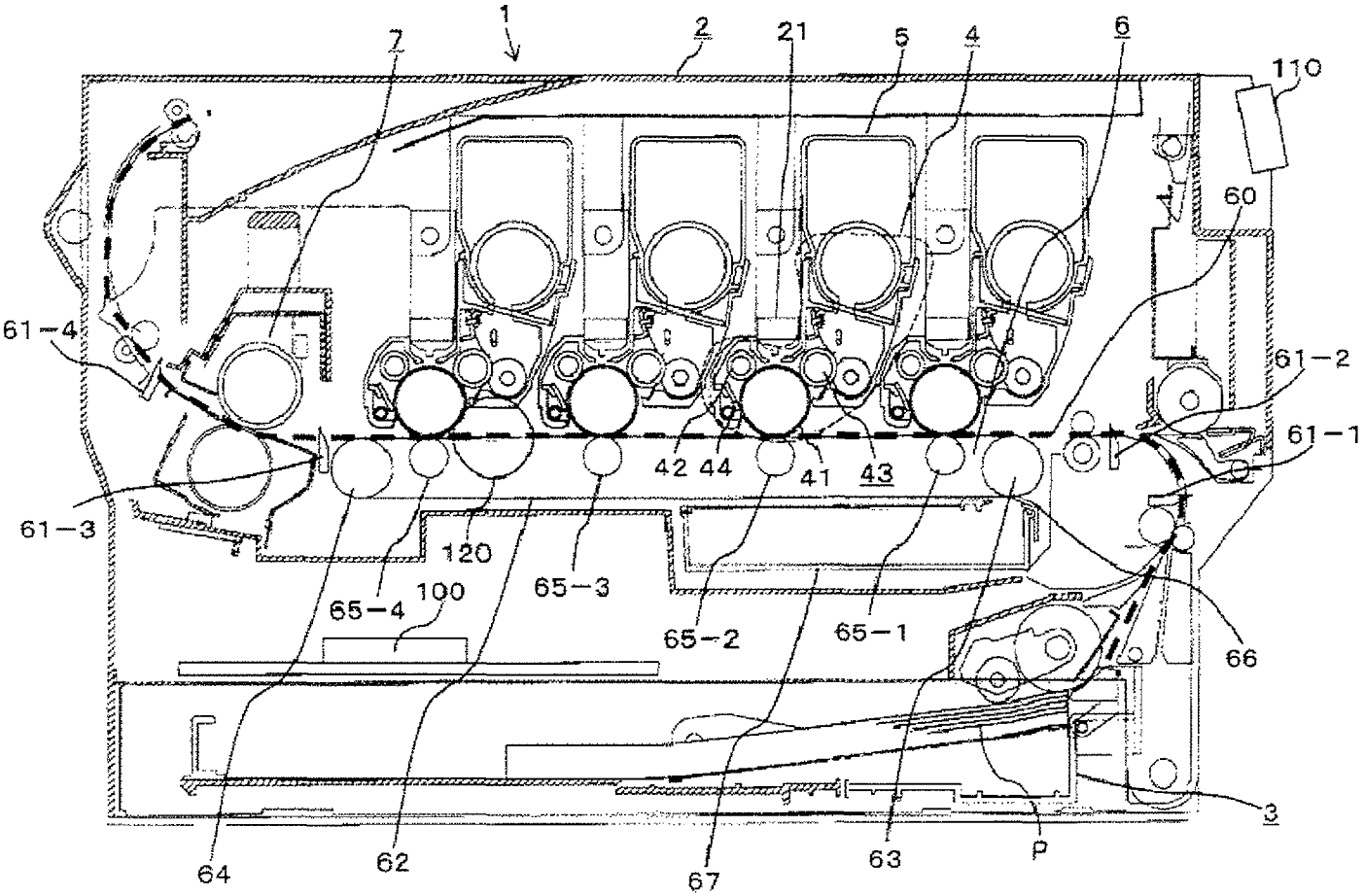
FIG. 1 illustrates a schematic diagram of the image forming device of a first embodiment of the present application.

First Embodiment (Configuration of Image Forming Device) FIG. 1 illustrates a schematic diagram of the image forming device according to a first embodiment. Moreover, FIG. 2 illustrates a detailed cross sectional view of the process cartridge and the toner cartridge of FIG. 1.

As shown in FIG. 1, a process cartridge 4 (image forming unit) of the first embodiment is detachably configured on a device main body 2 of an image forming device 1. As shown in FIG. 2, the process cartridge 4 includes a photosensitive drum 41, a charging device 42 that charges the surface of the photosensitive drum 41 by contacting it, a developing device 43 that forms an electrostatic latent image on the photosensitive drum 41 into a toner image and a cleaning device 44 that removes toner remaining on the surface of the photosensitive drum 41.

Figure 2:
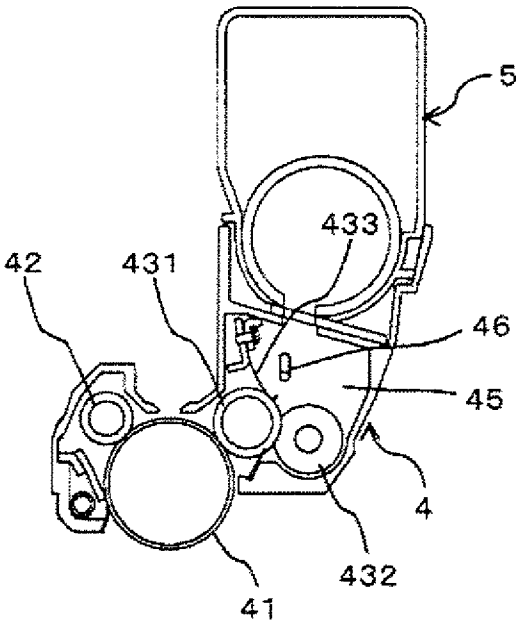
FIG. 2 illustrates a detailed cross sectional view of a process cartridge and a toner cartridge of FIG. 1.

The developing device 43 of the process cartridge 4 of FIG. 2 includes a toner supplying roller 432 that supplies toner to a developing roller 431. The developing roller 431 supports and carries the toner to the photosensitive drum 41, and a developing blade 433 regulates layer thickness of the toner that is supplied to the developing roller 431. On the upper part of the toner supplying roller 432, a toner containing part 45 for containing the toner supplied from the toner cartridge 5 is provided. On the toner containing part 45, a toner remaining amount detector 46 that is also a toner agitator is provided.

A side of a device main body 2 of the image forming device 1 of FIG. 1 includes an exposing device 21 for forming an electrostatic latent image on the photosensitive drum 41, a sheet carrying device, or carrying device, 6 that transfers the toner image on the photosensitive drum 41 to a recording sheet P (see FIG. 5) and that carries the recording sheet P, a sheet containing cassette 3 for containing the recording sheet (s) P, a sheet carrying path 60 that is a path for the recording sheet, a fusing device 7 that fuses the toner that is transferred to the recording sheet by heat and pressure, sheet sensors 61-1 through 61-4 that are provided on the sheet carrying path 60 and that sense the passing of the recording sheet, and a releasing mechanism 8 that lifts the other process cartridges when the process cartridge 4 is detached.

The sheet carrying device 6 is formed from a transfer belt 62, a belt driven roller 63, a drive roller 64, transfer rollers 65-1 through 65-4, a cleaning blade 66 and a cleaner container 67. The transfer belt 62 is made of a seamless high resistance semi-conductive plastic film that forms an endless loop around the belt driven roller 63 and the drive roller 64, and that is rotated by the drive roller 64.

The transfer rollers 65-1 through 65-4 are arranged diagonally to each of the process cartridges 4 and inside the upper part of the transfer belt 62, and are driven and rotated by the rotational movement of the transfer belt 62. The cleaning blade 66 is arranged to contact the transfer belt 62, which is in the position diagonal to the belt driven roller 63 at the bottom part of the transfer belt 62. Material such as toner that is scraped by the cleaning blade 66 is contained in the cleaner container 67.

Figure 3:
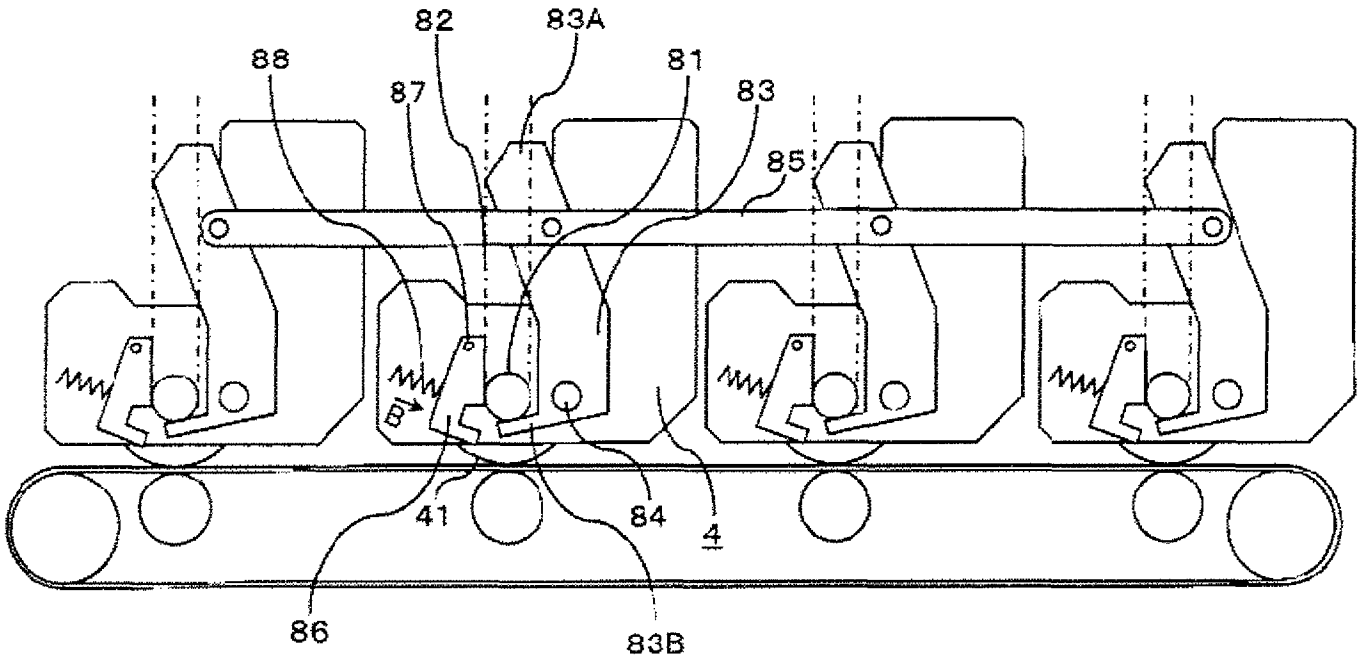
FIG. 3 illustrates a diagram showing a release mechanism of the process cartridge of FIG. 1.

FIG. 3 illustrates a diagram showing a release mechanism of a process cartridge of FIG. 1. A shaft 81 that penetrates through an axis center of the photosensitive drum 41 is provided on the process cartridge 4, and a guide 82 is provided on the device main body 2 side. The shaft 81 is configured to move up and down along with the guide 82 when the process cartridge 4 is detached from the device main body 2.

A lever 83 is installed on the device main body 2 so that it is rotatable at the lever supporting point 84. The lever 83 is configured to include an arm part 83A, or first arm part, that intersects with the guide 82 and receives force from the shaft 81 when the process cartridge 4 is being detached from the device main body 2, and an arm part 83B, or second arm part, that supports a weight of the process cartridge 4 and moves up and down the process cartridge 4.

A linkage 85 connects both the levers 83 that are provided per each process cartridge 4. A lock member 86 is mounted on the device main body 2 so that it is rotatable at a lock supporting point 87, and is biased in an arrow direction B by a compressed spring member 88.

Figure 4:
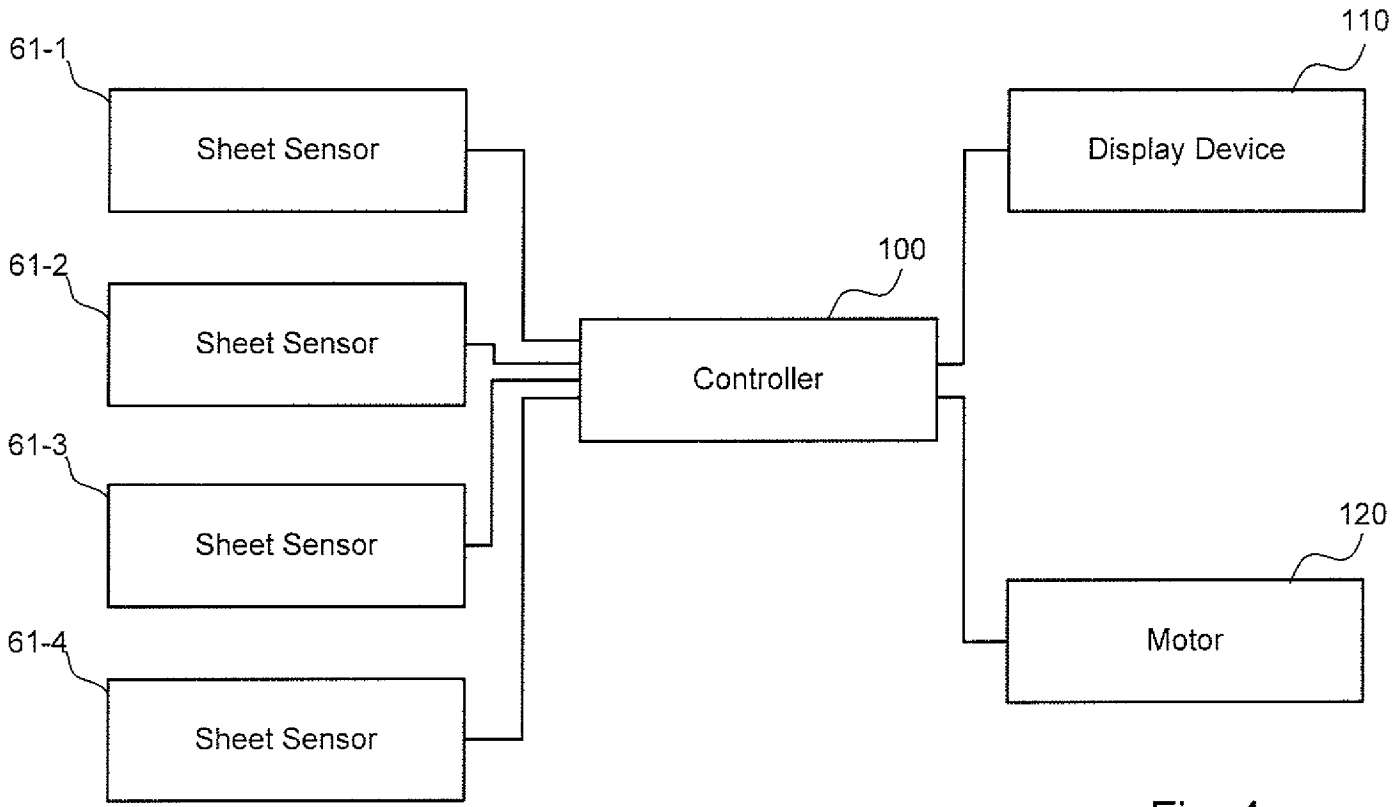
FIG. 4 illustrates a block diagram showing a configuration of a control system of FIG. 3.

FIG. 4 illustrates a block diagram showing a structure of a control system of FIG. 3.

The output signals of each of the sheet sensors 61-1 through 61-4 are input into a controller 100, and the controller 100 is configured to control a display device 110 and a motor 120.

Figure 5:
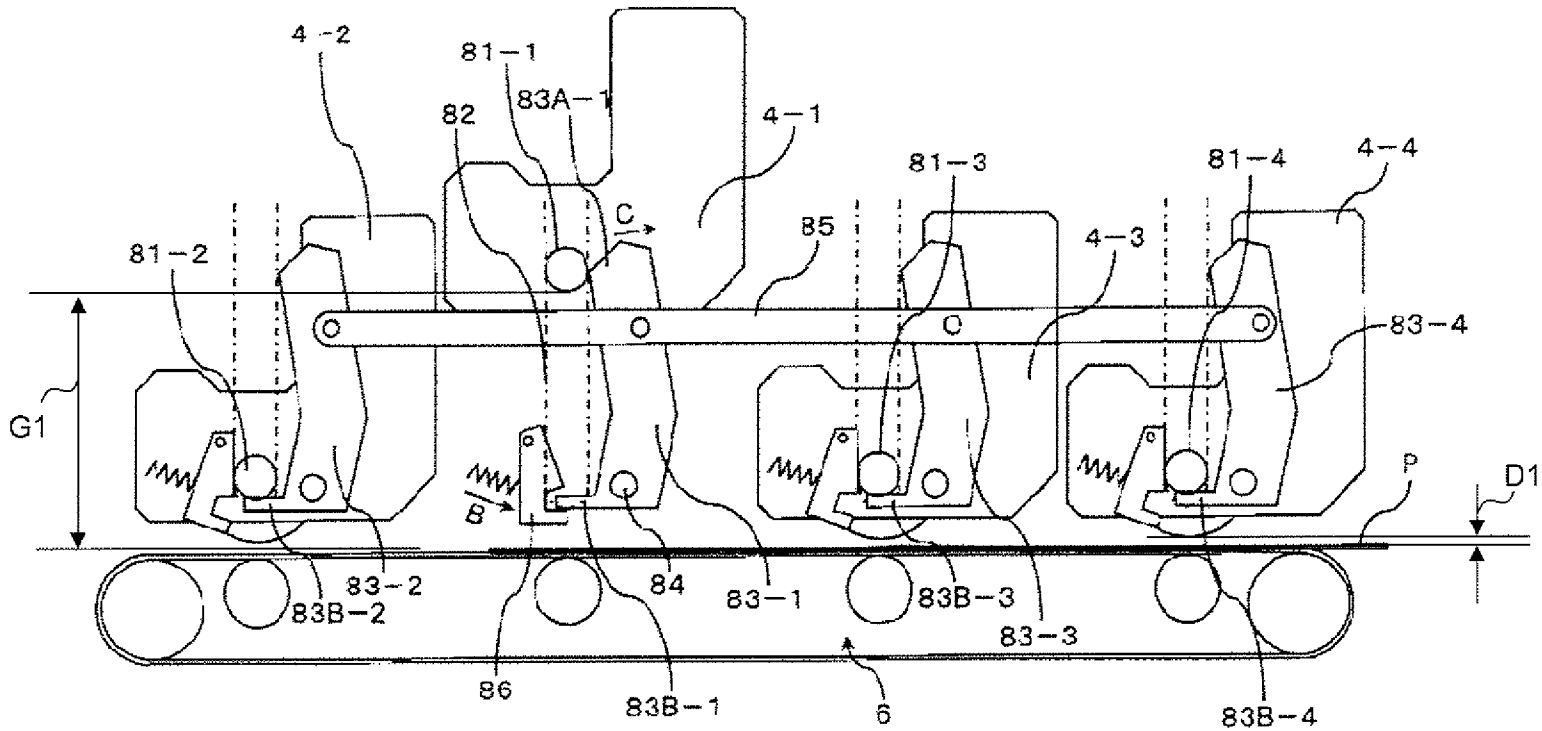
FIG. 5 illustrates a diagram showing an operation condition of the release mechanism of FIG. 3.
Figure 6A:
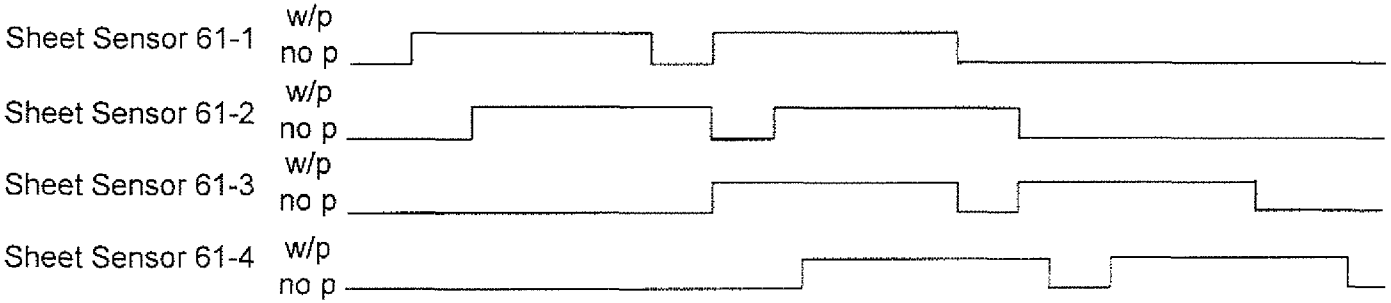
FIGS. 6A and 6B illustrate timing diagrams showing an operation condition (output wave form) of a sheet sensor.
Figure 6B:
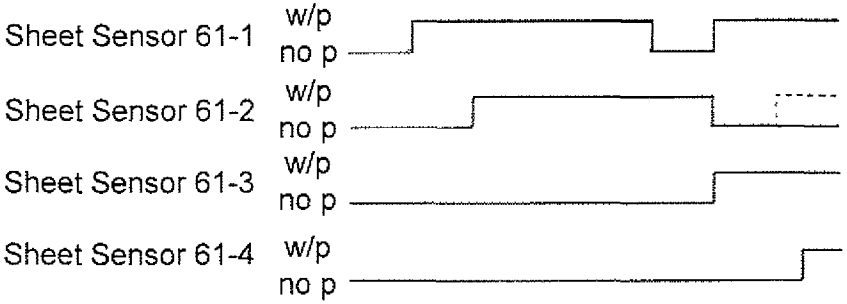

(Operation of Image Forming Device of First Embodiment) FIG. 5 illustrates a diagram showing an operation condition of the release mechanism of the process cartridge of FIG. 3. Moreover, FIGS. 6A and 6B illustrate a timing diagram showing an operation condition (output wave form) of a sheet sensor.

Referring to FIG. 1, in the image forming device 1, first of all, an electrostatic latent image is formed on the surface of the photosensitive drum 41 that is uniformly charged by the charging device 42 by being exposed to the exposing device 21. The electrostatic latent image that is formed on the surface of the photosensitive drum 41 is developed by the toner supplied through the developing device 43 and becomes a toner image. The toner image on the photosensitive drum 41 is transferred to the recording sheet P by the sheet carrying device 6. On the other hand, the toner remaining on the photosensitive drum 41 is removed and collected by the cleaning device 44.

Referring to FIG. 2, at the developing device 43, the toner is supplied on the developing roller 431 from the toner containing part 45 by the toner supplying roller 432. The toner that is supplied to the developing roller 431 is charged to a predetermined electric charge while it is formed into a thin layer by the developing blade 433.

As indicated by the dotted line sheet carrying path 60 in FIG. 1, the recording sheet P is ejected to the top surface or back surface of the device main body 2 after traveling from the sheet containing cassette 3, passing along the sheet carrying path 60, between each process cartridge 4 and the sheet carrying device 6, and then through the fusing device 7.

FIG. 6A shows an output wave form of each of the sheet sensors 61-1 through 61-4 when normal image forming operation is performed. Each of the sheet sensors 61-1 through 61-4 shows a high level output while a recording sheet is sensed (namely, the recording sheet is present, "w/p"), and shows a low level output when the recording sheet is not sensed (namely, not present, "no p"). Whether or not the recording sheet P is normally carried can be judged by observing the high level or low level interval of each of the sheet sensors 61-1 through 61-4.

On the other hand, FIG. 6B shows sensor outputs for each of the sensors 61-1 through 61-4 when an abnormality occurs as the recording sheet P is carried along the sheet carrying path 60. In this case, the controller 100 judges that the recording sheet P is jammed just before reaching the sheet sensor 61-2 because the sheet sensor 61-2 does not sense that the second recording sheet P has passed the sheet sensor 61-2 after passing the sheet sensor 61-1. Then, the controller 100 stops the motor 120, cancels carrying of the recording sheet P and image forming, and notifies the user that jamming occurred through a display device 110.

At this time, not only does the recording sheet P that is jammed need to be removed, but also another recording sheet P needs to be removed if the other recording sheet P has reached the sheet carrying device 6. The operation to remove the recording sheet P that remains in the sheet carrying device 6 is as follows.

As shown in FIG. 5, when for example the process cartridge 4-1 is lifted, the arm part 83A-1 of the lever 83-1 is pressed at the point where the shaft 81-1 elevated along with the guide 82 contacts the arm part 83A-1, and the lever 83-1 rotates in the arrow direction C centering around the lever supporting point 84. At this time, levers 83-2 through 83-4 of the other process cartridges 4-2 through 4-4 that are connected by the linkage 85 also rotate in the arrow direction C. As a result, the process cartridges 4-2 thorough 4-4 that are not lifted by hand are also lifted and are separated from the sheet carrying device 6 by a distance D1.

When the lever 83-1 is in a position such that the process cartridge 4-1 is lifted, a lock member 86 is operated in the arrow direction B, and the lever 83-1 is locked so that it does not return in the opposite direction of the arrow direction C. When the process cartridge 4-1 is completely removed, the lock member 86 still engages with the arm part 83B because of the biasing force so that all of the process cartridges 4-1 through 4-4 are separated from the sheet carrying device 6.

When the process cartridge 4-1 is mounted again, the lock is released, each of the levers 83-1 through 83-4 rotates, and each of the process cartridges 4-1 through 4-4 is lowered. Consequently, each of the process cartridges 4-1 through 4-4 contacts the sheet carrying device 6.

When an edge part of the recording sheet P can be seen through a window that is formed by detaching the process cartridge 4-1 from the sheet carrying device 6, the recording sheet P can be removed by pinching and pulling the recording sheet P from the sheet carrying device 6. At this time, all other process cartridges 4-2 through 4-4 that are not detached are in a separated position from the sheet carrying device 6. As shown in FIG. 5, the process cartridge 4-1 is located above the sheet carrying device 6 by a distance G1. On the other hand, the other process cartridges 4-2 through 4-4 are also above the sheet carrying device 6, but by a distance less than G1. Therefore, all of the process cartridges 4-1 through 4-4 are separated from the sheet carrying device 6. Accordingly, the recording sheet P is not pinched by any of the other process cartridges 4-2 through 4-4. Also, there is almost no load associated with removing the recording sheet P that is positioned at least partially beneath one of or more of the remaining process cartridges 4-2 through 4-4.

When the edge part of the recording sheet P is not located beneath an area from which the process cartridge 4-1 is removed, the user further can search for the recording sheet P in other area by detaching any one of the other process cartridges 4-2 through 4-4 in the same manner as the process cartridge 4-1. Additionally, after the previously detached process cartridge 4-1 is mounted again, and when any one of the process cartridges 4-1 through 4-4 is detached from the carrying device 6 by the above-mentioned detaching operation, all of the cartridges 4-1 through 4-4 become separated from the sheet carrying device 6 as described above in connection with the detachment of process cartridge 4-1. Therefore, the work required to remove the recording sheet P is reduced.

(Advantage of First Embodiment) According to the above first embodiment, when the recording sheet P is jammed or the like and needs to be removed from the sheet carrying device 6, it is necessary to detach only one of the process cartridges 4-1 through 4-4 so that all of the process cartridges 4-1 through 4-4 can be separated from the sheet carrying device 6 by the above described detaching operation. Accordingly, the recording sheet P can be easily removed wherever the recording sheet P is present (even if the recording sheet is present beneath a process cartridge that is not detached).

Second Embodiment (Configuration of Image Forming Device) FIG. 7 illustrates a diagram showing a release mechanism of the process cartridge of the image forming device according to a second embodiment. Like numbers are used for like elements of the first embodiment shown in FIG. 3.

The description of the basic configuration and the control system of the releasing mechanism in the image forming device 1 of the second embodiment are omitted as they are the same as the first embodiment.

A shown in FIG. 7, the shafts 81-1 that penetrate though an axis center of the photosensitive drum 41 is provided on the process cartridge 4-1, and the guide 82 is provided on the device main body 2 side. The shaft 81-1 is configured to move up and down along with the guide 82 when the process cartridge 4-1 is mounted in and detached from the device main body 2. The remaining process cartridges 4-2 through 4-4 are also configured in the same manner.

The lever 83-1 is installed on the device main body 2 so that it is rotatable at the lever supporting point 84. The lever 83-1 is formed from an arm part 83A-1, or a first arm part, that intersects with the guide 82 and receives force from the shaft 81-1 when the process cartridge 4-1 is being detached from the device main body 2, and an arm part 83B-1, or a second arm part, that supports a weight of the process cartridge 4-1 and that moves up and down the process cartridge 4-1. The remaining levers 83-2 through 83-4 are also installed and configured in the same manner.

A linkage 85A, or a first linkage, connects all of the levers 83-1 through 83-4 that are provided per each process cartridges 4-1 through 4-4. Another linkage 85B, or a second linkage, is engaged to the levers 83-2 and 83-4, the belt driven roller 63 and the drive roller 64 of the sheet carrying device 6. The second linkage 85B is attached at second linkage supporting points 88-2 and 88-4 in the process cartridges 4-2 and 4-4. The second linkage supporting points 88-2, 88-4 are respectively positioned predetermined distances L2, L4 from the lever supporting points 84-2, 84-4. With such a configuration, the sheet carrying device 6 is lowered when the levers 83-2 and 83-4 rotate in the direction C. Considering the first linkage 85A connecting all of the process cartridges 4-1 through 4-4 in a synchronous manner, the sheet carrying device 6 is lowered when any one of the process cartridges 4-1 through 4-4 is detached (removed). In the embodiment, the distances L2 and L4 are identical. However, the distances L2 and L4 may differ according to structural features of the image forming device. In general, the distance between the second linkage supporting point and the lever supporting point is referred as L. A lock member 86 is mounted on the device main body 2 so that it is rotatable at a lock supporting point 87, and is biased in an arrow direction B by a compressed spring member 88.

Figure 8:
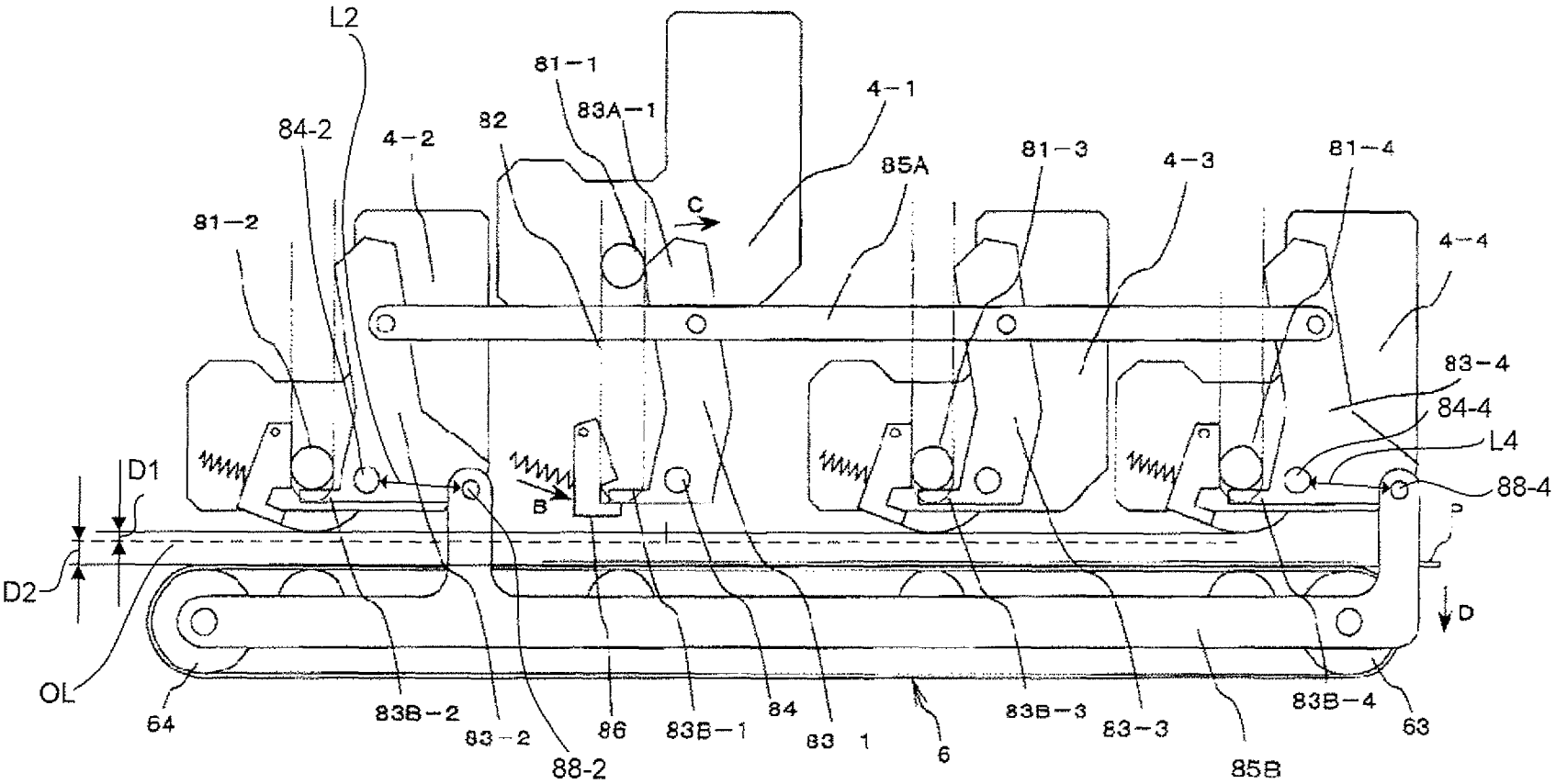

(Operation of Image Forming Device) FIG. 8 illustrates a diagram showing the operation condition of the release mechanism of FIG. 7.

As the image forming operation and jamming judging method are the same in the image forming device 1 of the second embodiment as in the first embodiment, their explanations are omitted.

Not only does the recording sheet P that is located at the jammed part need to be removed, but also another recording sheet P needs to be removed if the other recording sheet P has reached the sheet carrying device 6. The operation to remove the recording sheet P that remains in the sheet carrying device 6 is as follows.

When for example the process cartridge 4-1 is lifted, the arm part 83A-1 of the lever 83-1 is pressed at the point where the shaft 81 elevated along with the guide 82 contacts the arm part 83A-1, and the lever 83-1 rotates in the arrow direction C centering around the lever supporting point 84. At this time, levers 83-2 through 83-4 that are connected by the linkage 85B and that are at the position of other process cartridges 4-2 through 4-4 also rotate in the arrow direction C. Accordingly, the process cartridges 4-2 through 4-4 that are not lifted by hand are also lifted and are separated from an operating location of the sheet carrying device 6 by the distance D1.

Since the linkage 85B is engaged to the belt driven roller 63 and the drive roller 64 of the sheet carrying device 6 as well, the sheet carrying device 6 also shifts downwardly in an arrow direction D when the process cartridge 4-1 is lifted, thereby separating the sheet carrying device from its operating location by a distance D2. The operating location is represented with a dotted line OL. Accordingly, the distance between the remaining process cartridges 4-2 through 4-4 and the sheet carrying device 6 is D1 plus D2 (See FIG. 8).

When the lever 83-1 is in the position that the process cartridge 4-1 is lifted (detached), the lock member 86 moves in the arrow direction B, and the lever 83-1 is locked so that it does not return to the opposite direction in the arrow direction C. Namely, when the process cartridge 4-1 is completely removed from the image forming device, the lock member 86 engages with the arm part 838-1

When the process cartridge 4-1 is re-mounted, the lock is released, each of the levers 83-1 through 83-4 rotates, and each of the process cartridges 4-1 through 4-4 is lowered. At the same time, the sheet carrying device 6 returns to the original position. Accordingly, each of the process cartridges 4-1 through 4-4 contacts the sheet carrying device 6 again.

When the edge part of the recording sheet P can be seen through a window that is formed by detaching the process cartridge 4-1 from the sheet carrying device 6, and the recording sheet P is in the removal condition from the sheet carrying device 6, the recording sheet P can be removed by pinching and pulling out the recording sheet P from the sheet carrying device 6. At this time, all other process cartridges 4-2 through 4-4 that are not detached are separated from the sheet carrying device 6. Accordingly, the recording sheet P is not pinched by the process cartridges 4-2 through 4-4. Also, the work required to remove the recording sheet P is reduced.

Moreover, in the second embodiment, as the sheet carrying device 6 also is lowered at the same time, a space between the sheet carrying device 6 and each of the process cartridges 4-1 through 4-4 is further enlarged. As a result, removal of the recording sheet P is further simplified.

When any part of the recording sheet P is not seen through the window formed by detaching the process cartridge 4-1, any one of the other process cartridges 4-2 through 4-4 can be similarly detached so that the recording sheet P can be detected. At this time, the sheet carrying device 6 and each of the process cartridges 4-2 through 4-4 are separated by lifting any one of the other process cartridges 4-2 through 4-4 by the above-mentioned detaching operation even after the previously detached process cartridge 4-1 is re-mounted (installed). Therefore, removal of the recording sheet P is simplified.

(Advantages of Second Embodiment) According to the second embodiment, when jamming or the like occurs, and when it is necessary to remove the recording sheet P from the sheet carrying device, it is required to detach only any one of the process cartridges 4-1 through 4-4 from the sheet carrying device 6 so that the remaining process cartridges are also separated far from the sheet carrying device 6. Therefore, removal of the recording sheet P can be easily performed in a simplified manner. Moreover, the sheet carrying device 6 is lowered at the same time, and a distance between the sheet carrying device 6 and each of the process cartridges 4-1 through 4-4 is further enlarged, thereby further simplifying removal of the recording sheet P.

(Other Modification Examples of First and Second Embodiments) In the first and second embodiments, the image forming device 1 is explained as a color electrophotographic printer. However, the present application can be adapted to an image forming device that is equipped in a facsimile machine, a copier or a multiple function printer (MFP).

What is claimed is:

1. An image forming device, comprising:

a carrying device configured to carry a recording sheet in a predetermined carrying direction;

a plurality of image forming units that are arranged along the carrying direction and that are in contact with the carrying device; and a linkage that is connected to all of the image forming units, wherein when one of the image forming units is separated from the carrying device, the separated one of the image forming units moves the linkage, and the movement of the linkage subsequently separates remaining ones of the image forming units from the carrying device.

2. The image forming device of claim 1, wherein the image forming units are configured to contact the carrying device when all of the image forming units are mounted on the image forming device.

3. The image forming device of claim 1, wherein each of the plurality of image forming units comprises a process cartridge.

4. The image forming device of claim 3, wherein the process cartridge includes a photosensitive drum, a charging device for charging a surface of the photosensitive drum by contacting its surface, a developing device for making an electrostatic latent image into a toner image on the photosensitive drum and a cleaning device for removing toner remaining on a surface of the photosensitive drum.

5. The image forming device of claim 1, wherein each of the plurality of image forming units comprises a toner cartridge.

6. The image forming device of claim 1, further comprising:

levers respectively positioned corresponding to each of the image forming units, wherein the linkage is connected to the levers and is configured to rotate the levers to separate the image forming units from the carrying device when the one of the image forming units is detached from the carrying device.

7. An image forming device, comprising:

a carrying device configured to carry a recording sheet in a predetermined carrying direction; and a plurality of image forming units that are arranged along the carrying direction and that are in contact with the carrying device; and a linkage that is connected to all of the image forming units, wherein when one of the image forming units is separated from the carrying device, the separated one of the image forming units moves the linkage, and the movement of the linkage subsequently separates remaining ones of the image forming units and the carrying device from one another.

8. The image forming device of claim 7, wherein the carrying device is separable from the image forming units through detachment of one of the image forming units from the image forming device.

9. The image forming device of claim 7, wherein each of the plurality of image forming units comprises a process cartridge.

10. The image forming device of claim 9, wherein the process cartridge includes a photosensitive drum, a charging device for charging a surface of the photosensitive drum by contacting its surface, a developing device for making an electrostatic latent image into a toner image on the photosensitive drum and a cleaning device for removing toner remaining on a surface of the photosensitive drum.

11. The image forming device of claim 7, wherein each of the plurality of image forming units comprises a toner cartridge.

12. The image forming device of claim 7, wherein the sheet carrying device contacts the process cartridge when all of the plurality of image forming units are mounted on the image forming device.

13. The image forming device of claim 7, wherein the image forming units are configured to be separable from a carrying device operating location by a first distance (D1) when one of the image forming units is detached from the carrying device, and the carrying device is configured to be separable from the carrying device operating location by a second distance (D2) when the one of the image forming units is detached from the carrying device.

14. The image forming device of claim 7, further comprising:

levers respectively connected to each of the image forming units, wherein the linkage includes:

a first linkage that is connected to the levers and that is configured to rotate the levers to separate the image forming units from the carrying device operating location by the first distance (D1) when the one of the image forming units is detached from the carrying device; and a second linkage that is connected to at least one of the levers and to the carrying device, and that is configured to separate the carrying device from the carrying device operating location by the second distance (D2) when the one of the image forming units is detached from the carrying device.

15. An image forming device, comprising:

a main body that is a frame of the image forming device and that includes a carrying device configured to carry a recording sheet in a predetermined carrying direction and image forming units arranged along the carrying direction and in contact with the carrying device;

guides disposed on inner sides of the main body corresponding to each of the image forming units;

shafts that are parts of the image forming units and that are configured to fit in the guides so that the shafts are movable in the guides according to detaching and mounting operations of the image forming units;

levers that are respectively positioned in the vicinity of the guides, that have a first arm part and a second arm part, and that are respectively fixed to the main body at lever supporting points such that the levers are rotatable around lever supporting points;

lock members that are respectively positioned at sides opposite to the levers with respect to the guides, and that are respectively configured to engage with the second arm parts of the levers, and be biased toward the levers; and a first linkage that connects the levers so that the levers rotate in a synchronous manner, wherein when the image forming units are mounted, the shafts push back the lock members so that the second arm parts do not engage with the lock members, when one of the image forming units is detached, the shaft of the detached image forming unit pushes back the first arm part of the lever for the detached image forming unit so that the lever rotates around the lever supporting point in a detach direction, thereby causing the second arm part of the lever for the detached image forming unit to engage with the lock member of the detached image forming unit, and the first linkage moves so that levers for the remaining image forming units rotate in the detach direction, the second arm parts for the remaining image forming units push the shafts of the remaining image forming units upwardly so that all of the image forming units are separated from the carrying device, and when the image forming unit is removed, the lock member of the detached image forming unit still engages with the second arm part because of the biasing force so that the first linkage maintains all of the image forming units separated from the carrying device.

16. The image forming device of claim 15, wherein when the image forming units are mounted, the shafts push down the second arm parts so that the first arm parts are configured to be within the guides.

17. The image forming device of claim 15, further comprising:

a second linkage that is attached to the carrying device, wherein the second linkage is rotatably attached to at least two of the levers at second linkage supporting points, and the second linkage supporting points are positioned a predetermined distance (L) from the lever supporting point.

* * * * *